US005727750A

United States Patent [19]

Kelly

[11] Patent Number: 5,727,750

[45] Date of Patent: Mar. 17, 1998

[54] DISPENSING DEVICE FOR ROLLED SHEET MATERIAL

[76] Inventor: Timothy A. Kelly, 801 Virginia Ave., Salem, Va. 24153

[21] Appl. No.: 740,132

[22] Filed: Oct. 24, 1996

[51] Int. Cl.[6] ..... B65H 16/06

[52] U.S. Cl. ..... 242/596.3

[58] Field of Search ..... 242/596, 596.2, 242/596.3, 596.7, 596.8

[56] References Cited

U.S. PATENT DOCUMENTS 2,049,964 4/1936 Lawson .
2,978,197 4/1961 Anderson .
3,160,361 12/1964 Monahan .
3,239,156 3/1966 Castellano ..... 242/596.8
3,319,855 5/1967 Tucker et al. ..... 242/596.3
4,974,783 12/1990 Campbell ..... 242/596.3

*Primary Examiner*—John P. Darling
*Attorney, Agent, or Firm*—Dority & Manning

[57] ABSTRACT

A dispensing device is provided for rolled sheet material. The device includes a base member and oppositely facing arms hinged to the base member. The arms are movable between an open position and a folded position wherein the arms completely nest within the base member to form a flush surface with the base member. A dual acting biasing mechanism is provided to bias the arm members away from the base member in their folded position and to bias the arm members towards the base member in their open position.

16 Claims, 5 Drawing Sheets

DISPENSING DEVICE FOR ROLLED SHEET MATERIAL

BACKGROUND OF THE INVENTION

The present invention relates to a dispensing device for rolled sheet material, particularly paper towels, toilet paper, and the like. The device is particularly suited for use in a compartment or a space of a motor vehicle or vessel wherein space is limited and it is necessary for the device to be folded and stored when not in use.

Various devices are known in the art for holding or dispensing rolled paper products. For example, U.S. Pat. No. 2,049,964 to Lawson discloses a device having hinged arms which are biased inward when the arms are in a fully open position to assist the arms in securing the roll of material and to exert a frictional force on the roll. Likewise, U.S. Pat. No. 3,160,361 to Monahan discloses a molded plastic paper towel rack wherein the arms fold down to the base unit during manufacture, packaging, and shipping. U.S. Pat. No. 2,978,197 to Anderson discloses a push-button operated paper towel holder wherein a button may be depressed to retract a trunnion to allow a paper roll to be inserted or removed from the rack.

The dispensing devices disclosed in the prior art are generally suitable for residential or commercial applications. However, such devices have proven to be problematic in vehicle applications, such as heavy truck sleeper cabs, recreational vehicles, trailer compartments, marine vessels, and the like. In such applications or environments, space is very limited and it is desirable for the dispensing device to occupy as little space as possible when not in use. Additionally, it is desirable for the device to have a secure locking mechanism to securely lock or retain the holding arms when the device is not being used. Also, the support surfaces upon which such a device can be mounted are fairly limited in vehicle or vessel environments, and it is desirable to be able to mount the device on any support surface. For example, in typical applications of such devices, the dispensing unit is mounted to a horizontal surface so that the arm members hang down from the support surface, such as when the device is mounted under a cabinet. It may, however, be desirable in vehicle or other applications to mount the device on a top surface, such as a counter top or table. In this manner, the arms would extend upward from the support surface. Thus, the arm members should be readily retractable from their stored position and positionable regardless of the mounting attitude or angle of the device.

The present invention provides significant improvements over conventional devices known in the art and provides a device particularly suited for use in limited space compartments.

OBJECTS AND SUMMARY OF THE INVENTION

It is therefore a principal object of the present invention to provide an improved dispensing device for rolled sheet material, particularly paper products.

An additional object of the present invention is to provide a dispensing unit for rolled sheet material that is particularly suited for vehicle or vessel environments.

And yet a further object of the present invention is to provide a dispensing unit which folds into a securely locked unit in its inoperative position to minimize space and present a generally aesthetically pleasing appearance.

And still a further object of the present invention is to provide a dispensing unit which can be mounted at any attitude or angle on any support surface.

Still another object of the present invention is to provide a dispensing unit that is significantly more durable and robust than conventional household units and, thus, particularly well suited for vehicle applications.

Additional objects and advantages of the invention will be set forth in part in the following description, or may be obvious from the description, or may be learned through practice of the invention.

In accordance with the objects and purposes of the invention, a dispensing device for rolled sheet material is provided. The dispensing device comprises a base member and means for fixing the base member to a support surface. Any conventional mounting means may be utilized. The device includes oppositely facing arm members which are hingedly mounted at opposite ends of the base member. The arm members comprise an engaging member which is configured for engaging and holding a roll of sheet material. For example, the engaging member may comprise a protruding member which fits into a paper towel roll. The arm members are hinged relative to the base so as to be movable between a fully open position and a folded position. The base member includes recesses defined therein so that the arm members can nest within the recesses in their folded position and form a relatively flat and flush surface with the base member. In this manner, when the arms are in their folded position, the device appears as a relatively flat box or block member with no protruding parts.

The device also includes a releasable latching mechanism to lock the arm members in the base member in their folded position. A dual acting biasing mechanism is configured to bias the arm members away from the base member in their folded position and to bias the arm members towards the base member in their fully open position. In this manner, upon actuation of the latching mechanism, the arm members will spring away from the base member thereby allowing for an operator to easily grasp the arm members and open the arm members to their fully open position. This is a particularly useful feature when the device is mounted on a top support surface, such as a counter top or table.

The latching mechanism preferably includes a manual actuator, such as a push button type of actuator. The actuator causes engaging members to move out of contact with the arm members upon an operator pushing or actuating the manual actuator. This action allows the arm members to spring away from the base member. The engaging members are spring biased and movable so that the arm members can be pushed into the recesses defined in the base body. Once the arm members are nested in the recesses, the engaging members lock into latching recesses defined in the arm members by force of a biasing element or spring. Thus, the actuator and latching mechanism need not be engaged or operated in order to fold the arms into their folded position.

The arms are also biased inward in their fully open position so as to effectively grasp a roll of sheet material therebetween. The arms are also biased inward to provide a frictional force or break to the roll of material to prevent free rolling of the roll of material.

In a preferred embodiment of the device, the dual acting biasing mechanism comprises a relatively simple leaf spring. However, any conventional biasing element, such as a torsion spring or dual torsion springs, could be configured as a dual acting biasing mechanism. Additionally, separate elements, such as separate springs or torsion springs, could be configured to supply a dual acting biasing force.

The invention is described in more detail below with reference to the accompanying drawings.

DETAILED DESCRIPTION OF THE PREFERRED EMBODIMENTS

Figure 1:
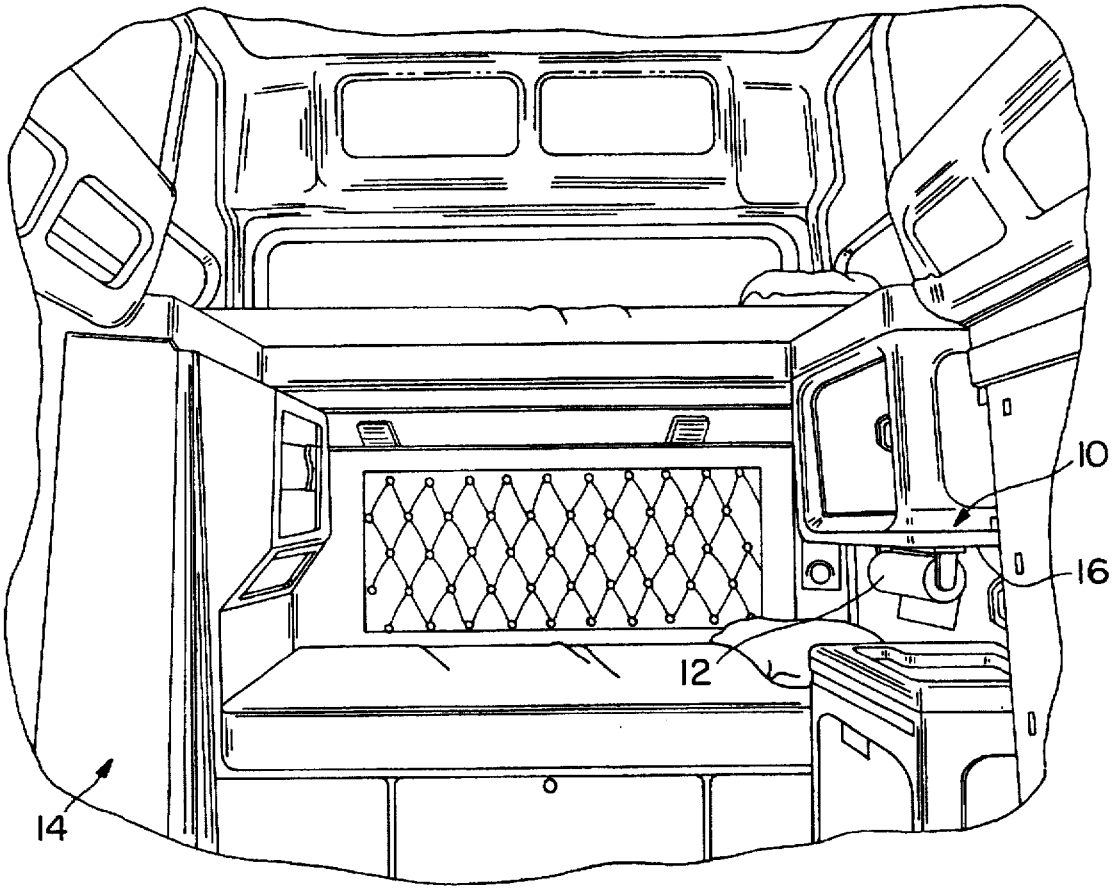
FIG. 1 is an environmental view of the dispensing device according to the invention utilized in a sleeper compartment of a commercial truck.

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For example, features illustrated or described as part of one embodiment, can be used on another embodiment to yield a still further embodiment. Thus, it is intended that the present invention cover such modifications and variations as come within the scope of the appended claims and their equivalents. Additionally, the numbering of components in the drawings is consistent throughout the application, with the same components having the same number in each of the drawings.

The present invention relates to a dispensing device, generally 10, for rolled sheet material, for example paper towels, toilet paper, and the like. FIG. 1 illustrates device 10 mounted in a conventional sleeper compartment 14 of a tractor trailer rig. Device 10 is illustrated mounted to a support surface 16 and holding a roll 12 of paper towels.

It should be understood that device 10 can be mounted to any flat support surface, including vertical surfaces, top surfaces, and the like. Device 10 is particularly suited in environments such as a trailer rig wherein space is at a premium. Thus, it should be understood, that device 10 is particularly useful in recreational vehicles, marine vessels, commercial trucks, etc. The device is also just as useful in residential and commercial building applications. The unique features of device 10 make the device, however, particularly suited for vehicle or vessel applications, as explained in more detail below.

Figure 2:
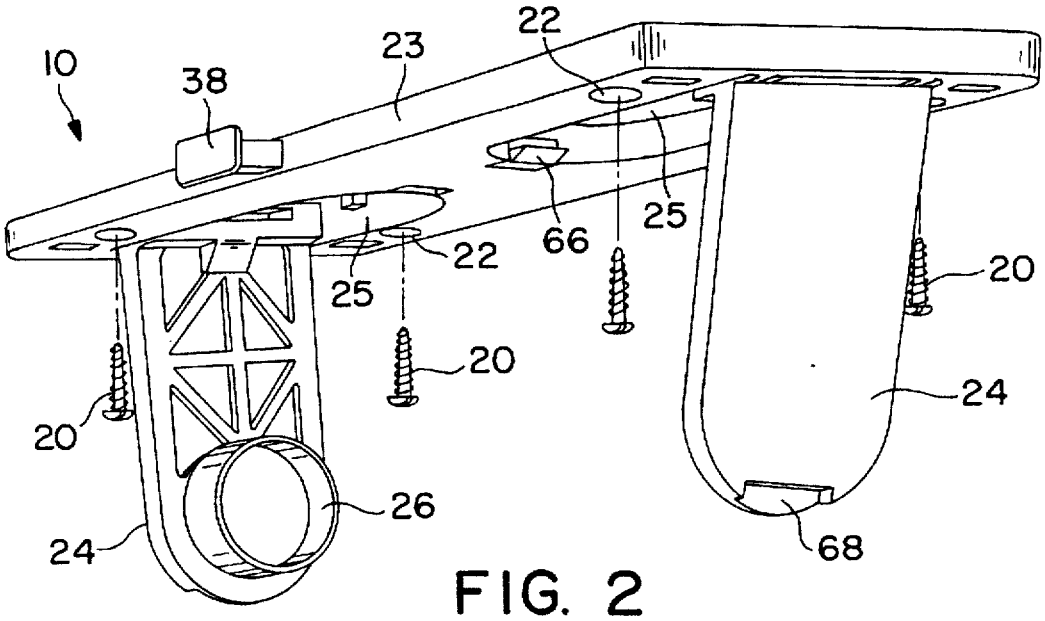
FIG. 2 is a perspective view of the dispensing device according to the invention.

FIG. 2 illustrates device 10 in a perspective view. Device 10 includes a base member 23. Base member 23 is preferably molded or formed of a lightweight yet strong fire retardant polymer or plastic material. Base member 23 is preferably rectangular in shape and has a depth to accommodate arm members, as described in more detail below.

Device 10 includes means for mounting base member 23 to any flat surface. In the embodiment illustrated, the mounting means comprise conventional screws 20 which fit through screw holes 22 defined through base member 23. However, it should be understood that any conventional mounting means can be utilized in this regard, for example adhesives, double sided tape, etc.

Figure 3:
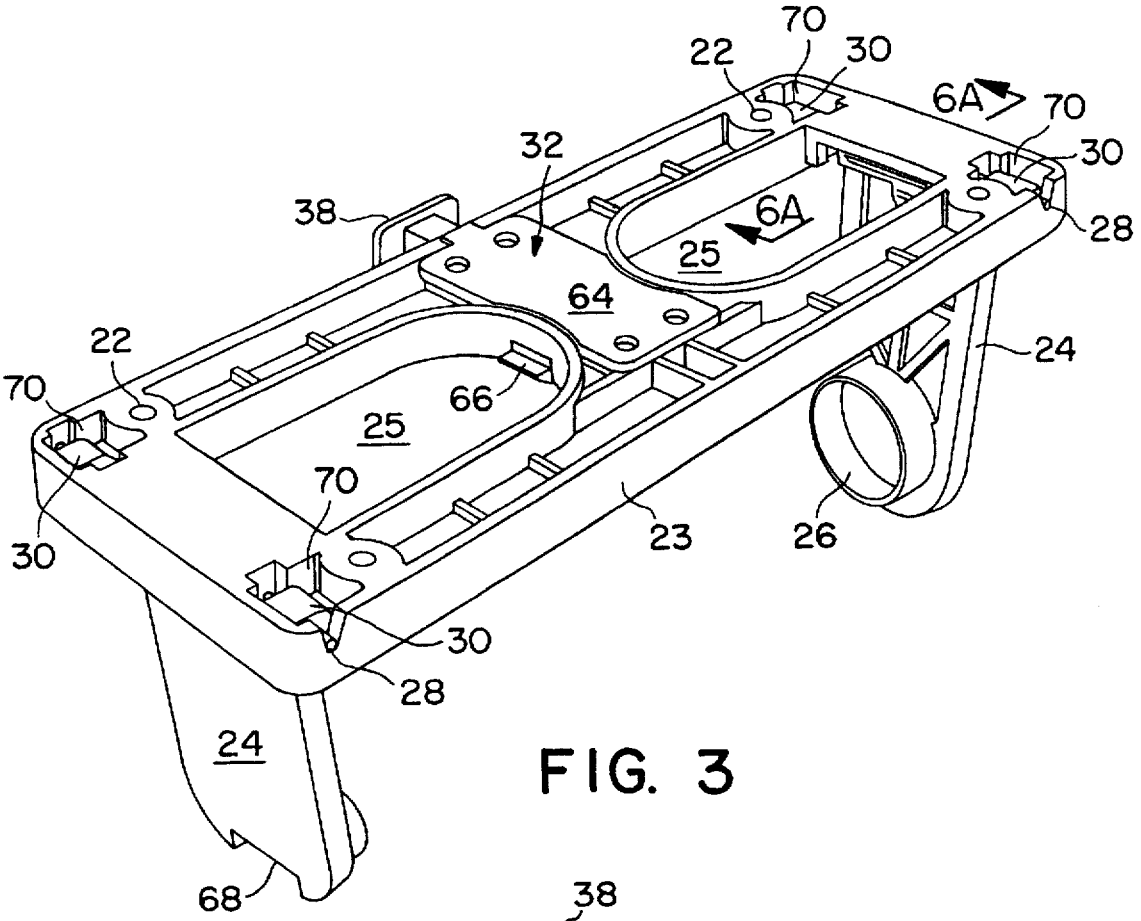
FIG. 3 is a bottom view of the device illustrated in FIG. 2.

Referring particularly to FIGS. 2 and 3, device 10 includes arm members 24 which are hinged to base member 23 by way of hinge pins 28. Hinge pins 28 extend through tabs 30 of arm members 24 and through base member 23. Tabs 30 reside in wells 70 defined in member 23. Arms 24 are hinged for movement between a fully open position, as illustrated in FIGS. 2 and 3, and a folded or closed position as illustrated in dashed lines in FIG. 5.

Referring particularly to FIG. 3, base member 23 defines recesses 25 for receipt of arm members 24. In their folded position, arm members 24 nest completely within recesses 25 to form a flush surface with base member 23, as particularly illustrated in FIG. 5. In this manner, when arms 24 are in their folded position, device 10 has virtually no protruding components. Device 10 thus presents a generally aesthetically pleasing appearance and eliminates the possibility of protruding components taking up valuable space or possibly causing a safety risk.

In the embodiment illustrated, recesses 25 are defined by generally oblong holes defined completely through base member 23. It should be understood that recesses 25 can also be defined by hollowed-out portions in base member 23.

Arm members 24 also preferably comprise engaging members 26 for contacting or holding a roll of sheet material. In the embodiment illustrated, engaging members 26 are defined by a generally circular protruding component which is sized to fit within the roll of conventional rolled paper products. It should be understood that engaging member 26 can be formed by any conventional device for holding the rolled material and allowing the material to unwind. For example, device 26 may include a rod which extends through the rolled material.

Device 10 also includes a releasable latching mechanism, generally 32, for locking arms 24 in their folded position relative to base member 23. In the folded position of arms 24, latching mechanism 32 securely maintains the arms nested within recesses 25 so that the outside surfaces of arms 24 form a generally flush surface with base member 23. In the embodiment of the device illustrated in the figures, releasable latching mechanism 32 includes a manual push button actuator 38. Actuator 38 is configured on the end of a first member 40. First member 40 is movable within a channel 34 defined in base member 23 along a first line of movement 42, as particularly illustrated in FIGS. 4*b* and 4*c*. First member 40 is spring loaded within channel 34 by way of spring 52. First member 40 is biased so as to move outward from base member 23. Stops 47 defined in first member 40 prevent the member from being ejected out of base member 23.

Figure 4A:
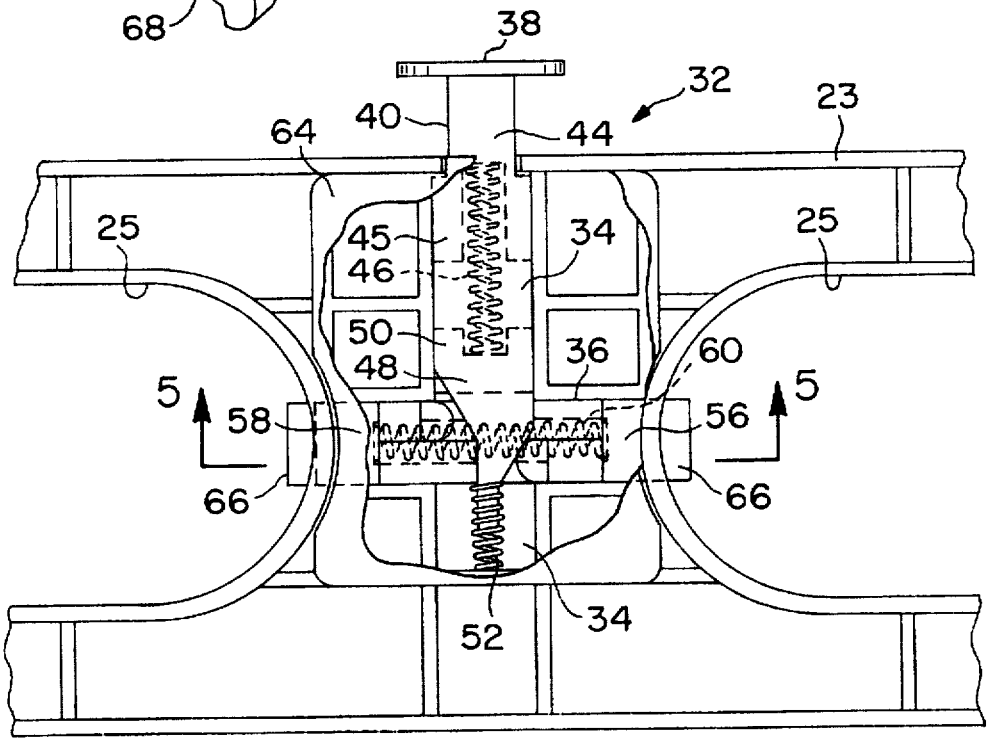
FIG. 4*a* is a partial cut-away view of the device illustrated in FIG. 3 particularly illustrating the latching mechanism.

Referring particularly to FIG. 4*a*, in a preferred embodiment first member 40 may comprise a first half 44 axially aligned with a second half 48. Halves 44 and 48 comprise leg portions 45, 50 respectively. A spring 46 is disposed between first half 44 and second half 48 and resides between the respective legs. Upon an operator pushing actuator 38 in the direction of arrow 42, first half 44 moves against the force of spring 46 until legs 45 engage legs 50 of the second half 48. At this point, further movement of actuator 38 causes the two halves to move as a single unit against the force of spring 52. This arrangement provides the latching mechanism with a "floating head" actuator. It should be understood, however, that first member 40 may be formed as a single rigid component.

Again referring to FIGS. 4a through 4c, latching mechanism 32 includes second members 56, 58, movable in a second channel 36 defined in base member 23 along a second line of movement indicated by arrows 59, 65. Second members 56, 58, are movable in a line of movement or direction essentially perpendicular to that of first member 40. Members 56 and 58 include adjacent longitudinal segments 61, 57 respectively. Followers 62, 63, are disposed at the ends of the longitudinal segments. Longitudinal segments 61, 57, are slidable relative to each other and are biased away from each other by means of a spring 60 disposed in a recess formed by members 56, 58. As particularly seen in FIGS. 4b and 4c, followers 63 and 62 are on opposite sides of first member 40, particularly opposite ramped surfaces 54, 55, defined on second half 48 of first member 40.

Figure 5:
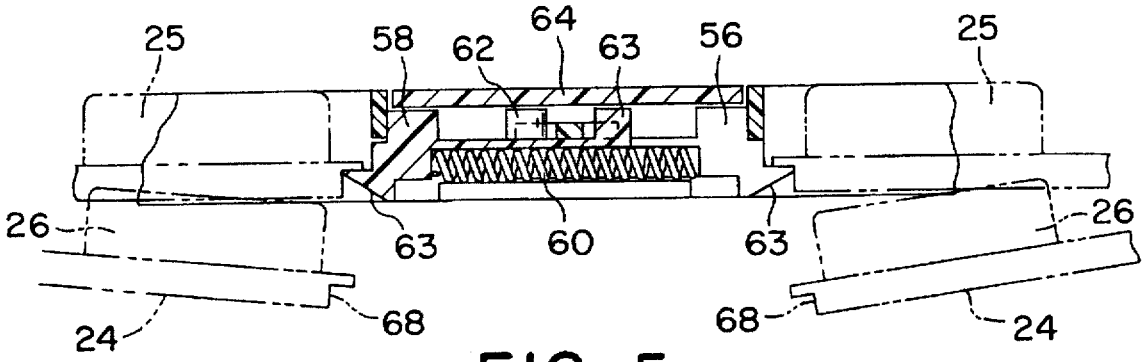
FIG. 5 is a partial cut-away side view of the device particularly illustrating the arm members in their folded position and released position.

FIG. 4a illustrates the latching mechanism 32 in its static position. Members 58, 60, include retaining lips 66 which extend into recesses 25. Retaining lips 66 engage in latching recesses 68 defined in the ends of arm members 24. Retaining lips 66 have ramped surfaces 63, as particularly seen in FIG. 5, which are engaged by arm members 24. In order to fold arm members 24 completely into recesses 25 as illustrated in FIG. 5, the operator simply pushes arm members 24 into the recesses. The portion of arm member 24 defining recess 68 engages ramped surface 63 of retaining lip 66 causing the respective second member to move against the force of spring 60 into base member 23. Once recess 68 passes retaining lip 66, the retaining lip springs back into recess 68 thereby locking the arm member into recess 25.

Referring to FIG. 4a, it can be seen that when respective second members 56, 58, are forced inward into base member 23 by an operator pushing arms 24 into recess 25 the followers 62, 63, move away from ramped surfaces 54, 55, within channel 36 against the force of spring 60. Once arms 24 are locked within recess 25, spring 60 biases members 56, 58, away from each other causing followers 62, 63, to move towards ramped surfaces 54, 55.

Figure 4B:
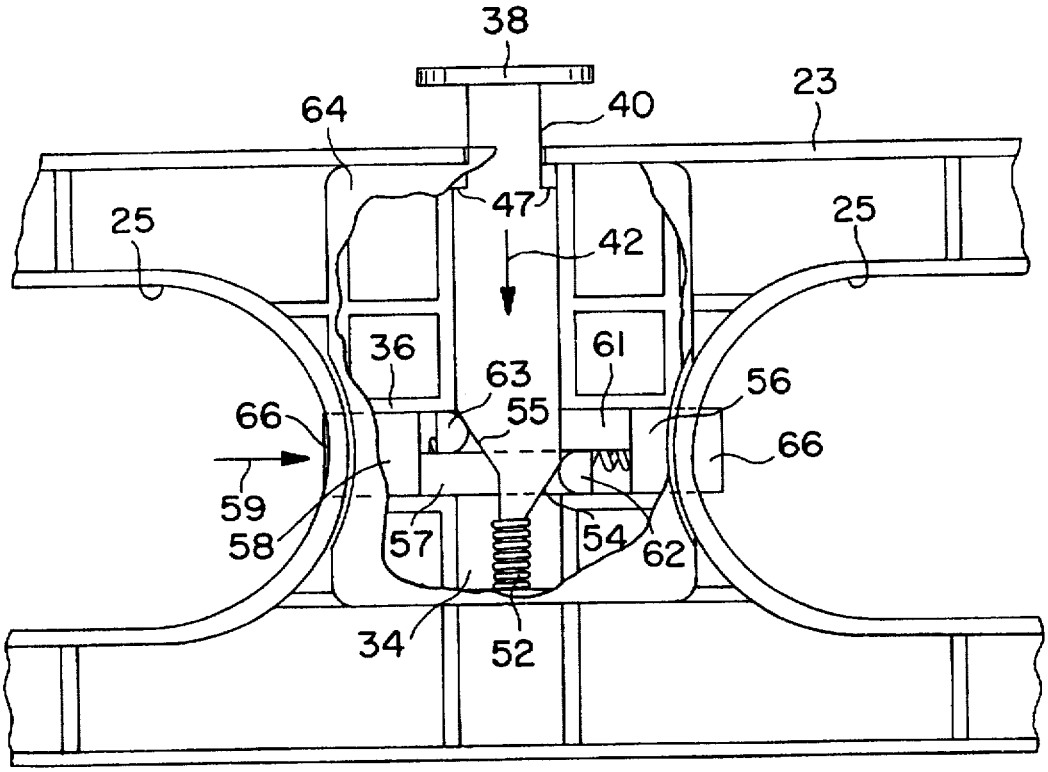
FIGS. 4*b* and 4*c* are sequential operational views of the latching mechanism.
Figure 4C:
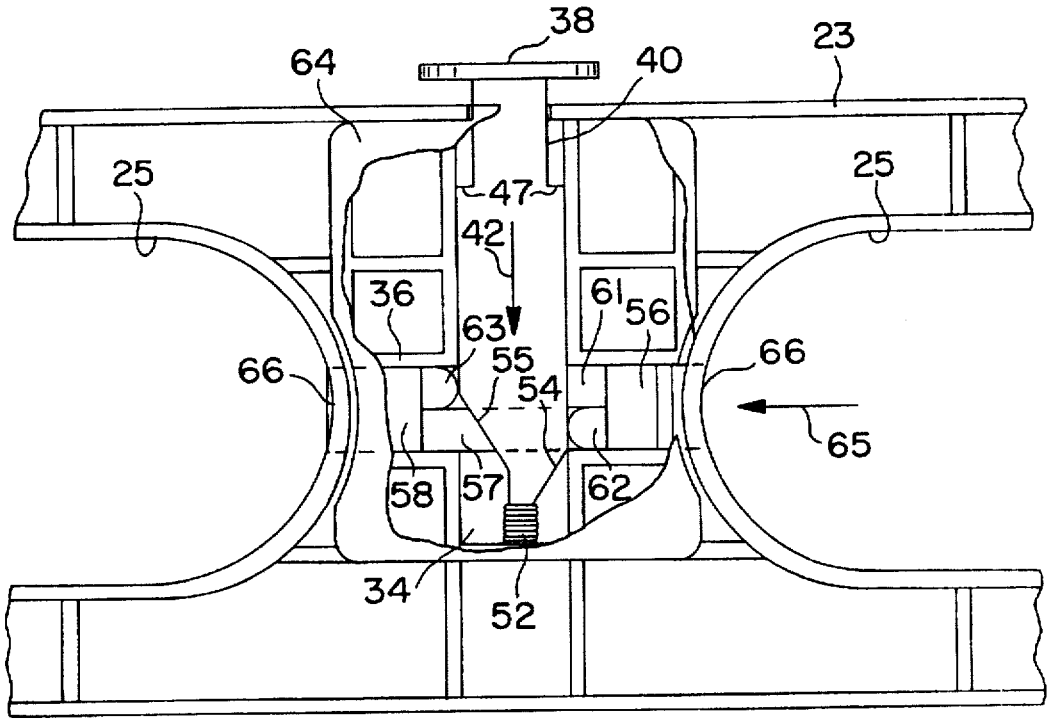

Actuation of releasable latching mechanism 32 is particularly illustrated in FIGS. 4b and 4c. FIG. 4b illustrates movement of actuator 38 in the direction of arrow 42 such that first ramped surface 54 engages follower 62 causing member 58 and its respective retaining lip 66 to be moved in the direction of arrow 59 into channel 36. Upon further movement of actuator 38, as illustrated in FIG. 4c, ramped surface 55 engages follower 63 causing member 56 and its respective retaining lip 66 to be moved in the direction of arrow 65 illustrated in FIG. 4c thereby releasing the other arm member 24 from its respective recess 25. Thus, in the embodiment illustrated, the arm members are released in sequence from base member 23 by movement of actuator 38 in the direction of arrow 42.

As shown in FIGS. 3 and 5, a backing plate 64 is attached to base member 23 to cover and protect the operating mechanism of releasable latch 32.

The embodiment of a releasable latching mechanism described herein is merely an example of a relatively inexpensive yet effective latching mechanism which can be utilized in device 10. It should be understood, however, that any manner of latching mechanism may be configured to releasably hold arm members 24 within recess 25. Any and all such latching mechanism are within the scope and spirit of the present invention.

Figure 6A:
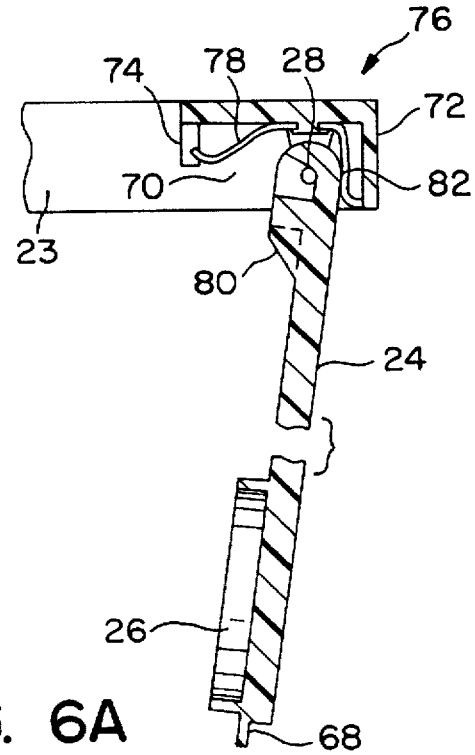
FIGS. 6*a* and 6*b* are cut-away side views of the dual acting biasing mechanism particularly illustrating the variable positions of the arm members.
Figure 6B:
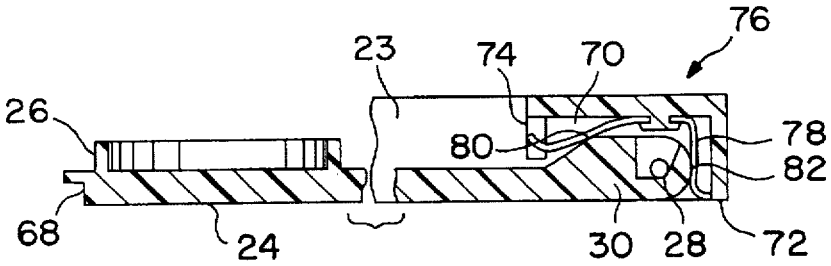

Device 10 also includes a dual acting biasing mechanism, generally 76, as illustrated in FIGS. 6a and 6b. Biasing mechanism 76 imparts a biasing force to arm members 24 away from base member 23 when arm members 24 are in their folded position. In this manner, arm members 24 spring away from base member 23 upon an operator actuating the releasable latching mechanism. This feature is particularly useful when device 10 is mounted to the top of a support surface, such as to a table top or counter top. An operator can thus simply grasp the arms once they have been ejected from base member 23 and move the arms to their fully open position.

Figure 7:
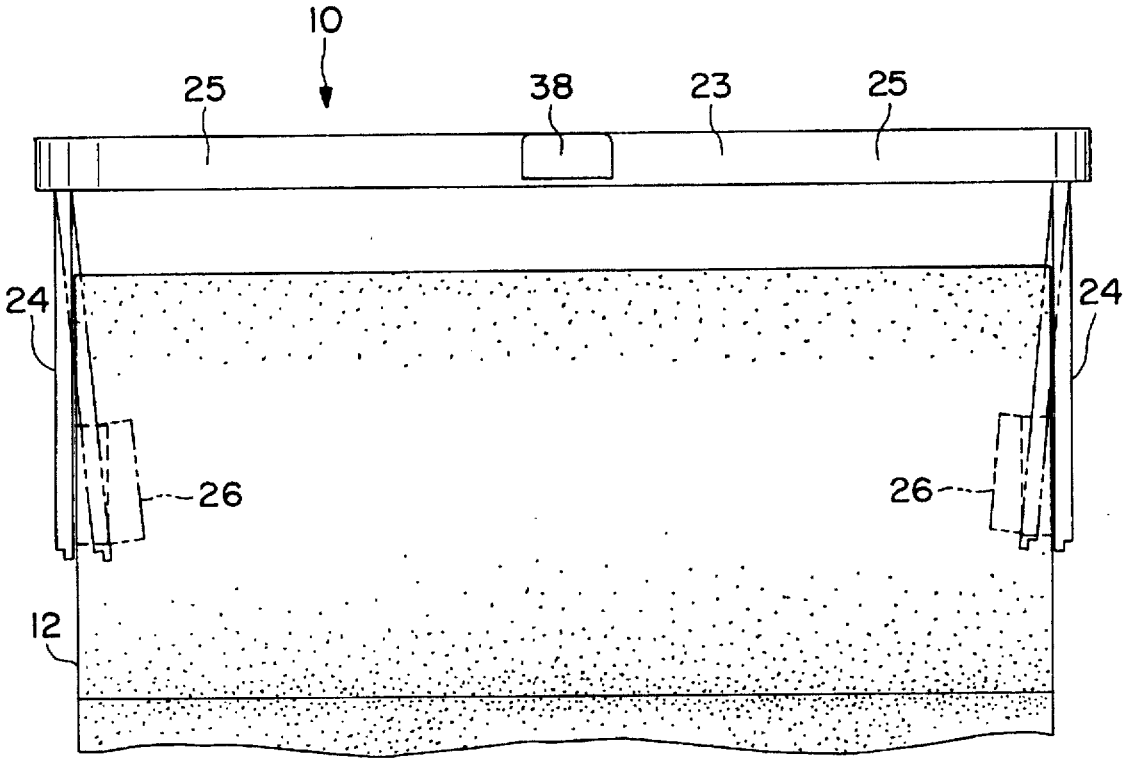
FIG. 7 is a view of the device holding a roll of sheet material.

Biasing mechanism 76 also provides a biasing force to the arms in their fully open position opposite to the first biasing force whereby the arms are biased towards the base member, as particularly in FIG. 7. In this manner, arms 24 are biased inwards in their fully open position so as to securely hold the roll 12 of sheet material and to also provide a frictional break to the roll 12 thereby preventing the roll 12 from free rolling movement.

One example of a suitable dual biasing mechanism is a leaf spring 78 illustrated in FIGS. 6a and 6b. Leaf spring 78 is disposed within a well 70 defined in base member 23. FIG. 6a illustrates arms 24 in their open position. A surface 82 of arm 24 engages against a first biasing leg of leaf spring 78 thereby biasing arm member 24 towards base member 23. FIG. 6b illustrates arm member 24 nested within recess 25. A second surface 80 of arm member 24 is contacted by a second biasing leg of leaf spring 78 imparting an outward biasing force to arm member 24. Well 70 is defined by stops 74 and 72 which ultimately limit or define the range of movement of arm members 24 about hinge pin 28.

It should be understood that dual biasing mechanism 76 can be formed by any conventional device, such as torsion springs, opposing springs, etc. Any and all such configurations are within the scope and spirit of the invention.

The components of device 10, particularly base member 23 and arms 24, are preferably formed of a lightweight fire retardant plastic or polymer material, but can be formed of any conventional material.

It should be understood by those skilled in the art that various modifications and variations can be made in the invention without departing from the scope and spirit of the invention. For example, any number of mechanical configurations can be utilized as the releasable latching mechanism. It is intended that the present invention cover such modifications and variations as come within the scope of the appended claims and their equivalents.

What is claimed is:

1. A dispensing device for rolled sheet material, said device comprising:

a base member, and means for fixing said base member to a support surface;

oppositely facing arm members disposed generally at opposite ends of said base member, said arm members further comprising an engaging member configured for engaging and holding a roll of sheet material, said arm members hinged relative to said base member so as to be movable between an open position and a folded position;

a releasable latching mechanism to lock said arm members to said base member in said folded position; and a dual acting biasing mechanism configured to bias said arm members away from said base member in said folded position of said arms and to bias said arm members toward said base member in said open position of said arms.

2. The dispensing device as in claim 1, further comprising recesses defined in said base member wherein said arm members nest within said recesses in said folded position so as to form a flush surface with said base member.

3. The dispensing device as in claim 1, wherein said latching mechanism includes a manual actuator for releasing said latching mechanism thereby allowing said arm members to spring outward away from said base member.

4. The dispensing device as in claim 3, wherein said actuator comprises a push-button type mechanism.

5. The dispensing device as in claim 3, wherein said latching mechanism comprises first member disposed for movement along a first movement line, and second members disposed for movement along a second movement line generally perpendicular to said first movement line, said second members having retaining lips formed thereon to hold said arm members in said folded position, wherein movement of said first member along said first movement line upon actuation of said actuator causes engaging surfaces of said first member to contact and move said second members along said second movement line so that said retaining lips move out of engagement with said arm members.

6. The dispensing device as in claim 5, wherein said second members move in opposite directions along said second movement line against a spring biasing force, said retaining lips move towards each other to release said arm members.

7. The dispensing device as in claim 6, wherein said engaging surfaces of said first member comprise opposite ramped surfaces, said second members comprising follower members engaged by said ramped surfaces, said second members pushed in opposite directions along said second movement line through engagement of said ramped surfaces and followers.

8. The dispensing device as in claim 7, wherein said first member comprises first and second halves spring biased in opposite directions along said first movement line, said actuator defined on said first half and said ramped surfaces defined on said second half which is movable relative to said first half upon said second members being engaged by said arm members and moved along said second line of movement when said arm members are folded into said folded position.

9. The dispensing device as in claim 8, wherein said retaining lips define ramped surfaces configured to be contacted and moved by said arm members as they are folded into said folded position, said retaining lips spring loaded to return and latch into latching recesses defined in said arm members.

10. The dispensing device as in claim 1, wherein said dual acting biasing mechanism comprises a leaf spring mechanism configured to act on said arm members.

11. A dispensing device for rolled sheet material, said device comprising:

a base member, said base member configured for mounting on a support surface;

oppositely facing arm members hingedly mounted on said base member and movable between a folded position and an open position, said arm members configured for engaging and holding a roll of sheet material in said open position;

a releasable latching mechanism to lock said arm members to said base member in said folded position; and arm recesses defined in said base member so that said arm members nest within said recesses in said folded position defining a flush surface with said base member.

12. The dispensing device as in claim 11, further comprising a dual acting biasing mechanism configured to bias said arm members away from said base member in said folded position of said arms and to bias said arm members toward said base member in said open position of said arms.

13. The dispensing device as in claim 12, wherein said latching mechanism comprises a manual actuator operably engaged with spring loaded retaining lips configured to contact and lock said arm members in said folded position.

14. The dispensing device as in claim 11, wherein said base member and arm members are formed substantially of a plastic material.

15. The dispensing device as in claim 11, wherein said latching mechanism is housed within said base member.

16. A dispensing device for rolled sheet material, said device comprising:

a base member, and means for fixing said base member to a support surface, said base member further comprising arm recesses defined therein;

oppositely facing arm members hingedly fixed at opposite ends of said base member, said arm members further comprising an engaging member configured for engaging and holding a roll of sheet material, said arm members movable between an open position for holding a roll of sheet material and a folded position wherein said arm members nest within said arm recesses and define a substantially flush surface with said base member;

a spring loaded releasable latching mechanism to lock said arm members to said base member in said folded position, said latching mechanism including a manual actuator operably configured with movable retaining members wherein actuation of said actuator causes movement of said retaining members against a biasing force out of engagement with said arm members; and a dual acting biasing mechanism configured to bias said arm members away from said base member in said folded position of said arms and to bias said arm members toward said base member in said open position of said arms.

* * * * *